United States Patent [19]

Mathews

[11] Patent Number: 4,860,625

[45] Date of Patent: Aug. 29, 1989

[54] BIMORPHIC PIEZOELECTRIC PICKUP DEVICE FOR STRINGED MUSICAL INSTRUMENTS

[75] Inventor: Max V. Mathews, Stanford, Calif.

[73] Assignee: The Board of Trustees of the Leland Stanford, Jr. University, Stanford, Calif.

[21] Appl. No.: 194,316

[22] Filed: May 16, 1988

[51] Int. Cl.[4] ..... G10H 3/18

[52] U.S. Cl. ..... 84/1.16; 84/DIG. 24

[58] Field of Search ..... 84/1.04, 1.14–1.16, 84/DIG. 24

[56] References Cited

U.S. PATENT DOCUMENTS

| | | | |
|---|---|---|---|
| 3,073,203 | 1/1963 | Evans | 84/1.16 |
| 3,453,920 | 7/1969 | Scherer | 84/1.16 |
| 3,712,951 | 1/1973 | Rickard | 84/1.14 |
| 4,278,000 | 7/1981 | Saito et al. | 84/1.16 |
| 4,306,480 | 12/1981 | Eventoff et al. | 84/1.16 X |
| 4,356,754 | 11/1982 | Fishman | 84/1.16 |
| 4,378,721 | 4/1983 | Kaneko et al. | 84/1.14 |
| 4,491,051 | 1/1985 | Barcus | 84/1.16 |
| 4,501,186 | 2/1985 | Ikuma | 84/1.16 |
| 4,567,805 | 2/1986 | Clevinger | 84/1.16 |
| 4,750,397 | 6/1988 | Ashworth-Jones | 84/1.16 |

OTHER PUBLICATIONS

*Piezoceramic Bender Elements,* Piezo Electric Products Inc., Metuchen, NJ (publication date unknown).

*Primary Examiner*—Stanley J. Witkowski

*Attorney, Agent, or Firm*—Flehr, Hohbach, Test, Albritton & Herbert

[57] ABSTRACT

A pickup is disclosed for a stringed musical instrument having a plurality of strings. The pickup includes a bridge member having a surface which supports the strings at predefined positions along the surface, a plurality of bimorphic piezoelectric elements embedded in the bridge member at locations corresponding to the predefined positions along the surface of the bridge member, and connection wires for conveying the electric signals generated by said bimorphic piezoelectric element. Each bimorphic piezoelectric element has two oppositely polarized piezoelectric layers, separated by a metallic layer. The bimorphic piezoelectric elements are embedded in the bridge member so that the principal direction of vibrations of the corresponding string is normal to the metallic layer which separates the two piezoelectric layers of the bimorphic element. As a result, the vibrations of each string bend the corresponding bimorphic element imbedded in the bridge, so that the pickup is directly responsive to vibrations of the strings of the musical instrument. In the preferred embodiment, the bridge includes separate support beams, separated by notches or slots, for each string so as to isolate each bimorphic element from the vibrations of the other strings, thereby providing distinct electrical signals corresponding to the vibrations of each string.

7 Claims, 2 Drawing Sheets

BIMORPHIC PIEZOELECTRIC PICKUP DEVICE FOR STRINGED MUSICAL INSTRUMENTS

The present invention relates generally to a pickup device for stringed musical instruments, and more particularly to a pickup for string instruments using bimorphic bender elements.

BACKGROUND OF THE INVENTION

The use of piezoelectric pickups for electric stringed instruments, such as electric guitars, is well known. Representative patents on this subject include U.S. Pat. Nos. 3,453,920 (Schere, 1969), 3,712,951 (Rickard, 1973), 4,356,754 (Fishman, 1982), 4,378,721 (Kaneko et al., 1983), 4,491,051 (Barcus, 1985), 4,501,186 (Ikuma, 1985), 4,567,805 (Clevinger, 1986).

In spite of the amount of effort by various persons and companies to develop a piezoelectric pickup for stringed instruments, the prior art devices have continued to be less than totally satisfactory. The inventor of the present invention has discovered that the "pressure sensitive" nature of standard piezoelectric pickups is inherently inconsistent with requirements of an ideal pickup. As will be described below, the present invention solves the primary problems of the prior art devices by using a pickup which is "bend sensitive" instead of "pressure sensitive".

Ideally, a pickup for stringed instruments should faithfully reproduce the vibrations of each string as a distinct electric voltage. In order to do this, the pickup should have the following properties:

1. The pickup for each string should be located close to the string so that no intervening structure modifies or filters the vibration of the string.

2. The pickup for each string should be properly oriented with respect to the principal plane of the string's motion, so that the pickup accurately senses the string's vibration.

3. The pickup for each string should be closely coupled to the string's motion, and should not pick up the vibrations of other strings.

4. The pickup should be part of the bridge of the instrument since that is where the vibrations are transmitted to the body of an acoustic instrument.

5. The pickup should allow the instrument's strings to be mounted in a normal fashion, i.e., to pass over a bridge with a small notch in it for each string, so that the player will be able to easily replace strings in the normal fashion for the instrument.

Clearly, these requirements or properties of an ideal pickup are somewhat overlapping.

The requirement that each pickup should sense the vibrations of only one string is, in part, derived from the MIDI specification for music synthesizer controllers, which requires that a separate input signal be provided for each sound generator in the synthesizer.

Most commercial pickups are deficient in one or more of these properties, which partially accounts for the well known differences in timbre between electronic and acoustic instruments. For example, the electromagnetic pickups used in standard electric guitars are not mounted on the guitar's bridge. In some cases they do not generate separate signals for each of the guitar's strings.

The prior art includes bridge mounted, piezoelectric pressure sensitive pickups for electronic violins, but these pickups are generally mounted far from the string, or in an orientation in which coupling to the string is marginal, or in a way which makes replacing the string awkward. In addition, the performance of these pressure sensitive pickups (i.e., the quality of the signals generated) is adversely affected by vibration of the entire pickup elements. For example, referring to FIGS. 1A and 1B, if the string 10 passes over a notch 12 in the bridge 14 of the instrument and a pressure sensitive pickup 16 is embedded (e.g., in a cavity 18 or 20) in the bridge 14, then the coupling will be unsatisfactory regardless of the orientation of the pickup element because the sound velocity in the bridge is so high that the transmitted string vibration will cause the entire pickup element to vibrate rather than putting vibratory pressure on the pickup element. If the pickup is placed under one foot of the bridge, it is so far from the string that the bridge structure will filter the string's vibration in an unsatisfactory manner, attenuating important high frequency components of the string's vibration.

Referring to the plan view of a violin or cello pickup shown in FIG. 1C, one method of properly coupling a string 10 to a pressure sensitive pickup 22 which was considered by the inventor before developing the present invention is to have the string 10 press against the pickup itself in an orientation where the string vibrations are normal to the pressure sensitive surface of the pickup. In FIG. 1C, a pickup assembly 21 for one string is shown, positioned on the instrument's bridge 14. Pressure sensitive piezoelectric element 22 is encased in cylindrically shaped hard plastic member 24 that is held in place by an aluminum support 26. The string 10 presses up against the pickup assembly 21 at all times, and vibrations of the string 10 directly translate into pressure changes in the piezoelectric element 22. While this enables the pickup to provide a good waveform, the string 10 must bend slightly where it crosses the pickup so that the tension in the string will press it against the pickup 21. Arranging the bridge 14 and the tailpiece 30 for holding the end of the strings to produce such a bend in the strings makes it awkward to mount the string on the instrument and causes problems in tuning the string.

The present invention is premised on the observation that the prior art piezoelectric pickups use pressure sensitive elements, and that it is difficult to properly couple the string vibrations of a bowed or plucked string instrument to these pressure sensitive elements. From one perspective, pressure sensitive elements are inherently unsatisfactory because the nature of the tones and sounds generated by the strings in stringed instruments is vibratory, not fluctuating pressures.

It is therefore a primary object of the present invention to provide a pickup for stringed instruments which s directly responsive to the vibrations of the instrument's strings. Another object of the present invention is to provide a pickup which produces an independent electrical signal for each string of an instrument.

SUMMARY OF THE INVENTION

In summary, the present invention is a pickup for a stringed musical instrument having a plurality of strings. The pickup includes a bridge member having a surface which supports the strings at predefined positions along said surface, a plurality of bimorphic piezoelectric elements embedded in the bridge member at locations corresponding to the predefined positions along the surface of the bridge member, and connection wires for conveying the electric signals generated by said bimorphic piezoelectric elements.

Each bimorphic piezoelectric element has two oppositely polarized piezoelectric layers, separated by a metallic layer. The bimorphic piezoelectric elements are embedded in the bridge member so that the principal direction of vibrations of the corresponding string is normal to the metallic layer which separates the two piezoelectric layers of the bimorphic element. As a result, the vibrations of each string bend the corresponding bimorphic element imbedded in the bridge, so that the pickup is directly responsive to vibrations of the strings of the musical instrument.

In the preferred embodiment, the bridge has separate supports for each string, separated by notches or slots, so as to isolate each bimorphic element from the vibrations of the other strings, and to thereby provide distinct electrical signals corresponding to the vibrations of each string.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

The present invention uses a bimorphic piezoelectric element as a pickup imbedded in the bridge of a string instrument, instead of a pressure sensitive piezoelectric pickup. The structure of a bimorphic piezoelectric element sometimes referred to herein as a "bimorph", is shown in FIG. 2.

The bimorphs or bimorphic piezoelectric elements used in the present invention have a variety of equivalent names, including piezoelectric bender, piezoceramic bender, and bilaminar piezoelectric element.

Figure 1A:
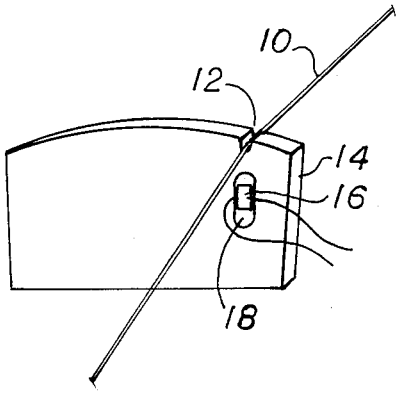
FIGS. 1A, 1B and 1C depict pressure sensitive piezoelectric pickups for stringed instruments.
Figure 1B:
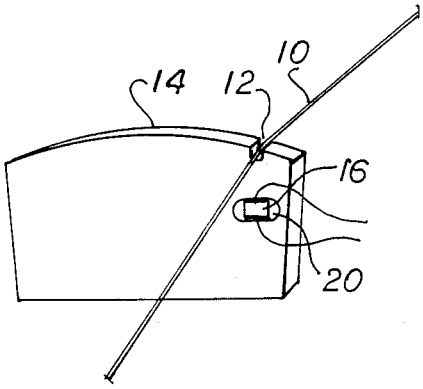
Figure 1C:
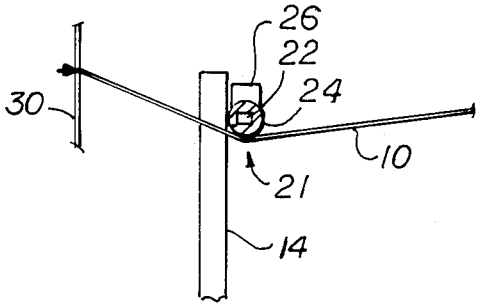
Figure 2:
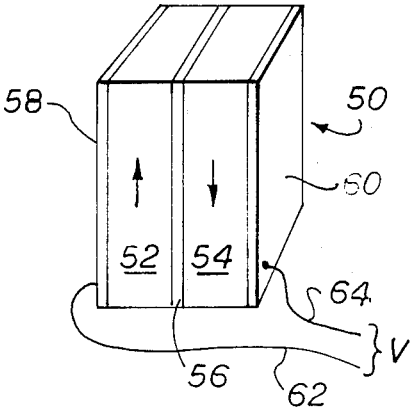
FIG. 2 depicts the structure of a bimorphic piezoelectric bender sensor.

As shown in FIG. 2, the bimorph 50 comprises two layers 52 and 54 of oppositely polarized piezoelectric material arranged in a sandwich structure, with a metallic layer 56 separating the two piezoelectric layers, and metallic electrodes 58 and 60 on the outer surfaces of the two piezoelectric layers. When the bimorph is bent, e.g., by application of unbalanced forces to the two sides of the bimorph, one of the piezoelectric layers will be in compression while the other will be in tension (i.e., relative to the other layer). Since the two piezoelectric layers are polarized in opposite directions, and are serially connected, the opposite stresses in each layer will produce electrical outputs on lines of like polarity. The electrical output of the bimorphic piezoelectric structure on output lines (i.e., electrically conductive wires) 62 and 64 is the summation V of the outputs of the two piezoelectric layers.

In summary, the voltage V generated by a bimorphic piezoelectric element 50 is proportional to the amount and direction that the element is bent. As a result, when the bimorphic piezoelectric element 50 is subject to vibration, the output voltage generated by the element 50 will be a waveform which tracks the intensity and frequency characteristics of the vibration. Furthermore, bimorphic piezoelectric elements can sense frequencies well above the 20 KHz frequency range that is audible to humans—and therefore can sense the full frequency range (i.e., 10 to 20,000 Hz) needed for sensing vibrations in stringed musical instruments.

Bimorphic piezoelectric elements are commercially available (e.g., from Piezo Electric Products in Metuchen, NJ) and are typically very sensitive detectors of vibrations—small deflections produce substantially voltage, typically on the order of several volts.

Figure 3:
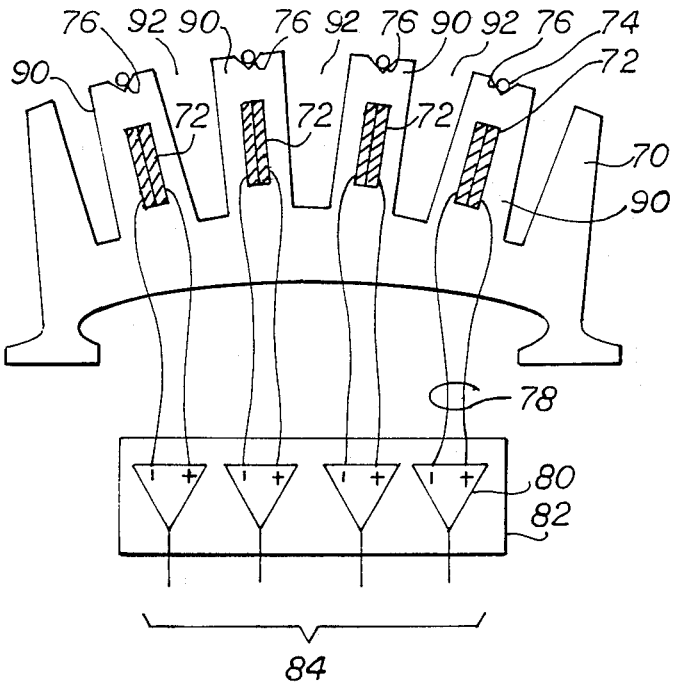
FIG. 3 depicts a violin bridge with bimorphic piezoelectric pickups for each violin string, and a set of amplifiers for amplifying the signals generated by the pickups.

If FIG. 3, there is shown a bridge 70 for a violin or cello. Four bimorphic piezoelectric pickups 72 are embedded in the bridge 70, each directly below a corresponding string 74. Bimorphic piezoelectric elements are very sensitive and even very small bimorphic elements produce excellent signals. As a result, it is possible to insert bimorphic piezoelectric elements into a standard size violin bridge and to use the modified bridge on an acoustic violin. In this way one can build a violin that is both an acoustic violin with a built in amplifier pickup, and also an electronic violin.

To embed bimorphic pickup elements in a bridge 70, a thin slit of approximately 1 to 2 millimeters is cut into the bridge 70 under each string notch 76, and then a bimorphic piezoelectric element of comparable width is inserted into each of the slits in the bridge 70.

The bimorphic piezoelectric elements 72 are oriented so that the metallic plane 56 (FIG. 2) of each element 72 is normal (i.e., perpendicular) to the primary plane of vibration of its corresponding string. Since the primary plane of vibration for each violin string is more or less sideways, or collinear with the curved upper surface of the bridge 70, the bimorphic elements 72 are aligned with the radial lines terminating at each of the string notches 76.

Each bimorphic piezoelectric element 72 generates a voltage proportional to the amount that element is bent, and this voltage is transmitted over a pair of wires 78. However, while piezoelectric elements 72 generate excellent voltage signals, they generate very little current. Therefore, in order to generate a set of useful output signals, the voltage signal generated by each of the bimorphic elements 72 on wires 78 is amplified by an operational amplifier 80.

Amplifier 82 shown in FIG. 3 comprises four operational amplifiers 80 for amplifying the output signals generated by four pickups 72. The amplified output signals generated by amplifier 82, on wires 84, are suitable for use as the input signals to an acoustic amplifier or a music synthesizer.

In the preferred embodiment the four operation amplifiers 80 in amplifier 82 are mounted on a printed circuit board that is coupled to the bridge 70 so as to minimize the length of the wires 78, and thereby reduce the opportunity for introducing noise into the amplified signals.

Another feature of the preferred embodiment shown in FIG. 3 is decoupling of the several pickups 72 in the bridge 70. This is accomplished by using a bridge 70 with a separate beam 90 for supporting each string 74. Slots 92 between the beams 90 are made sufficiently deep, and the pickups 72 are embedded sufficiently high in each beam 90, that the center of each bimorphic piezoelectric element 72 is above the bottom of the neighboring slots. In general, the bimorphic element 72 must extend sufficiently far into the corresponding beam 90 that it will be bent by the vibrations in that beam 90, but will not be bent by vibrations in the other beams. In the preferred embodiments, all or virtually all of the length of each pickup element is above the bottom of the neighboring slots. As a result, each pickup is essentially coupled only to the string mounted on the beam 90 in which the pickup is embedded, and is decoupled from the strings mounted on the other beams. In other words, the vibrations from each individual string produce very little response in the outputs of the pickups for the other strings.

Having decoupled pickups for the different strings is very important when using an electronic violin or cello as a control sensor for a synthesizer, because such decoupling is necessary if each string is to be used to control a different aspect of the sounds generated by the synthesizer. Having the string pickups decoupled is also desirable for an amplified or electronic stringed instrument because it enables the player to individually adjust the loudness and timbre of each string, and to thereby tune an instrument so that it has uniform sound on all strings.

Figure 4:
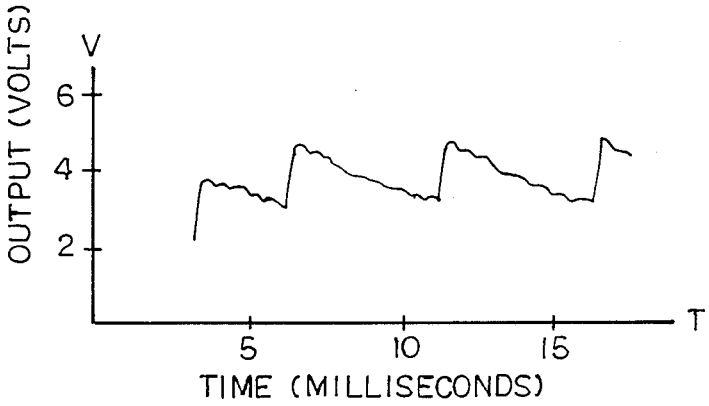
FIG. 4 depicts the waveform generated by a bimorphic piezoelectric pickup mounted in the bridge of a cello in accordance with the present invention.

FIG. 4 depicts the waveform generated by a bimorphic piezoelectric pickup mounted in the bridge of a cello in accordance with the present invention. The waveform of violin and cello string vibrations is known to be a sawtoothed shaped function of time. Since bimorphic pickups in accordance with this invention produce sawtooth waveforms, this indicates that these pickups accurately sense the vibrations of the strings. The oscillations superimposed on the sawtooth waveform shown in FIG. 4 are also consistent with well known characteristics of violin and cello string vibrations.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

For instance, in some applications (e.g., a stringed instrument with two or more strings tuned to each tone produced by the instrument) each support beam 90 of the bridge member may be used to support a set of related strings. Clearly, this version of the invention should only be used in circumstances where the combined vibrational signals generated by the pickups for each set of strings is useful by itself—i.e., without reference to the vibrations of the individual strings.

What is claimed is:

1. A pickup for a stringed musical instrument having a plurality of strings, comprising: a bridge member having a surface which supports the instrument's strings at predefined positions along said surface, and a plurality of bimorphic piezoelectric elements embedded in said bridge member at locations corresponding to said predefined positions along the surface of said bridge member;

wherein said bimorphic piezoelectric elements each comprises two oppositely polarized piezoelectric layers, separated by a metallic layer, said piezoelectric element being embedded in said bridge member so that said metallic layer is substantially coplanar with the corresponding string and the principal direction of vibrations of the corresponding string is normal to said metallic layer of said bimorphic piezoelectric element; whereby said pickup is directly responsive to vibrations of the strings of the musical instrument.

2. A pickup for a stringed musical instrument having a plurality of strings, comprising: a bridge member having a surface which supports the instrument's strings at predefined positions along said surface, and a plurality of bimorphic piezoelectric elements embedded in said bridge member at locations corresponding to said predefined positions along the surface of said bridge member; said bridge member including a plurality of beams separated by slots between the beams, one said beam for supporting each of the instrument's strings, wherein said bimorphic piezoelectirc elements are embedded in said bridge member so that at least a portion of each said bimorphic piezoelectric element extends into a corresponding one of said beams and oriented so that said bimorphic piezoelectric elements bend in response to vibrations of said strings, each bimorphic piezoelectric element providing distinct electrical signals corresponding to the vibrations of the string supported by the corresponding beam.

3. A pickup as set forth in claim 2, wherein said bimorphic piezoelectric elements extend sufficiently far into the corresponding beams that each bimorphic piezoelectric elements senses the vibrations in the corresponding beam of said bridge member but is substantially decoupled from vibrations in the other beams.

4. A pickup as set forth in claim 2, wherein said bimorphic piezoelectric elements extend sufficiently far into the corresponding beams that the center of each bimorphic piezoelectric element is above the bottom of the neighboring slots and so that each bimorphic piezoelectric element bends in proportion to the vibrations of the string supported by the corresponding beam.

5. A pickup as set forth in claim 2, wherein said pickup includes connection means for conveying electric signals generated by said bimorphic piezoelectric elements, and amplifier means coupled by said connection means to each of said bimorphic piezoelectric elements for amplifying electric signals generated by said bimorphic piezoelectric elements.

6. A pickup for a stringed musical instrument having a plurality of strings, comprising: a bridge member having a surface which supports the instrument's strings at predefined positions along said surface, and a plurality of bimorphic piezoelectric elements embedded in said bridge member at locations corresponding to said predefined positions along the surface of said bridge member;

said bimorphic piezoelectric elements each comprising two oppositely polarized piezoelectric layers separated by a metallic layer, said piezoelectric element being embedded in said bridge member with said metallic layer substantially coplanar with the corresponding string so that said pickup bends and generates electric signals in response to vibrations of the strings of the musical instrument.

7. A pickup for a stringed musical instrument having a plurality of strings, comprising: a bridge member having a multiplicity of separate cantilevered beams, each said beam having means for supporting one string; and a multiplicity of bimorphic piezoelectric elements, one bimorphic piezoelectric element embedded in each of said beams and oriented so that each said bimorphic piezoelectric element bends and generates electric signals when a string supported by the corresponding beam vibrates.

* * * * *